United States Patent [19]

Endriz

[11] 4,142,123

[45] * Feb. 27, 1979

[54] IMAGE DISPLAY DEVICE WITH OPTICAL FEEDBACK TO CATHODE

[75] Inventor: John G. Endriz, Trenton, N.J.

[73] Assignee: RCA Corporation, New York, N.Y.

[ * ] Notice: The portion of the term of this patent subsequent to Jun. 14, 1994, has been disclaimed.

[21] Appl. No.: 767,477

[22] Filed: Feb. 10, 1977

[51] Int. Cl.[2] ..... H01J 31/48; H01J 43/00

[52] U.S. Cl. ..... 313/400; 313/105 R

[58] Field of Search ..... 313/400, 102

[56] References Cited

U.S. PATENT DOCUMENTS

| | | | |
|---|---|---|---|
| 2,231,691 | 2/1941 | Snyder | 313/105 |
| 2,727,183 | 12/1955 | Marshall | 313/381 X |
| 3,767,968 | 10/1973 | Ogle | 315/169 TV |
| 3,825,922 | 7/1974 | Ralph | 315/169 TV X |
| 3,904,923 | 9/1975 | Schwartz | 315/169 TV |
| 4,001,619 | 1/1977 | Endriz et al. | 313/400 X |
| 4,001,620 | 1/1977 | Endriz | 313/400 X |
| 4,029,984 | 6/1977 | Endriz | 313/400 X |
| 4,034,255 | 7/1977 | Catanese et al. | 313/400 |

*Primary Examiner*—Robert Segal

*Attorney, Agent, or Firm*—Eugene M. Whitacre; Glenn H. Bruestle; George E. Haas

[57] ABSTRACT

An image display device includes at least one display cell having the following in spaced relation: a photocathode; multiplier dynodes, an anode electrode; and a cathodoluminescent screen. In addition to an optical feedback fluorescent material, the anode electrode includes a material which exhibits slow fluorescence, e.g., $Y_2O_3$:Gd3%, such that it emits light energy for a finite time period after it has been excited by electrons. In the operation of the display device, an electrical discharge is employed to produce the desired optical output at the cathodoluminescent screen. Some of the electrons created in the discharge strike the anode electrode, causing light energy to be directed to the photocathode where it is converted into free electrons. The presence of these free electrons ensures the rapid initiation of subsequent electrical discharges. In other embodiments, the electrical discharge may be obtained through ion feedback or plasma discharge.

11 Claims, 7 Drawing Figures

IMAGE DISPLAY DEVICE WITH OPTICAL FEEDBACK TO CATHODE

BACKGROUND OF THE INVENTION

This invention relates to an image display device, and particularly to such a device and method of operating the same in which an electrical discharge is employed to result in an optical output.

There presently exist several display devices which include the use of an electrical discharge for creating an optical output and hence, a desired display. By an electrical discharge device, it is meant a cell which releases energy, partially in the form of light, through the acceleration of electrons and the feedback of electron created species, such as photons or ions, whereby additional electrons are produced.

Among these devices are conventional plasma discharge cells, such as the one shown in U.S. Pat. No. 3,767,968, issued Oct. 23, 1973. Optical feedback and ion feedback discharge cells are other forms of such display devices. Exemplary optical feedback display devices are shown in U.S. Pat. No. 3,825,922, issued July 23, 1974, entitled "Channel Plate Display Device Having Positive Optical Feedback," and in copending application, Ser. No. 636,096, filed Nov. 28, 1975, now U.S. Pat. No. 4,029,984 entitled "A Fluorescent Discharge Cold Cathode for an Image Display Device." Exemplary ion feedback display devices are shown in the following: U.S. Pat. No. 3,904,923, issued to J. Schwartz, Sept. 9, 1975, entitled, "Cathodo-Luminescent Display Panel;" U.S. Pat. Nos. 4,001,619 and 4,001,620 issued to J. Endriz et al., and Endriz, respectively, dated Jan. 4, 1977, each entitled "Modulation Mask for an Image Display Device," and copending patent application, Ser. No. 672,122 of Endriz et al., filed Mar. 31, 1976, entitled, "Parallel Vane Structure for a Flat Display Device."

Although these display devices are suitable for some purposes, they have one common problem: relatively slow addressing time. Rapid addressing is difficult to obtain since each of these devices requires a finite amount of time before the necessary electrical discharge can be initiated due to the presence of a free charge, i.e., free electrons. In some of these display devices, especially where background radiation and thermionic emission are employed to produce the necessary initiating charge, the free charge may not be present until an undesirably long time has passed so as to limit the addressing time of the display device. The problem of slow addressing time is most acute in device applications which are to provide television type viewing since, for example, cells should be capable of a rapid repetition rate, i.e., one-thirtieth or one-sixtieth of a second. In addition, depending upon the particular addressing scheme employed, e.g., line-at-a-time addressing, the cell must be capable of assuming its full "on" position within an extremely short time period, i.e., less than 1 μsec after the cell is turned on in the case of certain line addressing schemes. Thus, it would be desirable to develop a display device in which means are provided for ensuring the presence of free charge so as to allow rapid addressing.

SUMMARY OF THE INVENTION

An image display device includes a plurality of cells with each of the cells including an enclosure. Each of the cells includes a cathode which emits electrons upon impingement by photons. Means are provided for establishing an electrical discharge so as to result in an optical output. Additional means are provided for storing a portion of the energy of the electrical discharge and then employing the stored energy to establish a subsequent electrical discharge.

A method of addressing a display device of the type having an enclosure, a cathode within the enclosure, and means for establishing an electrical discharge within the enclosure so as to result in an optical output. The method includes establishing a first electrical discharge within the enclosure so as to result in a first optical input. A portion of the energy of the electrical discharge is stored in the enclosure wherein at least some of the electrical discharge energy is converted into photon energy. Then, some of the stored energy is employed to help initiate a second electrical discharge in the enclosure so as to result in a second optical output.

DETAILED DESCRIPTION OF THE INVENTION

Figure 1:
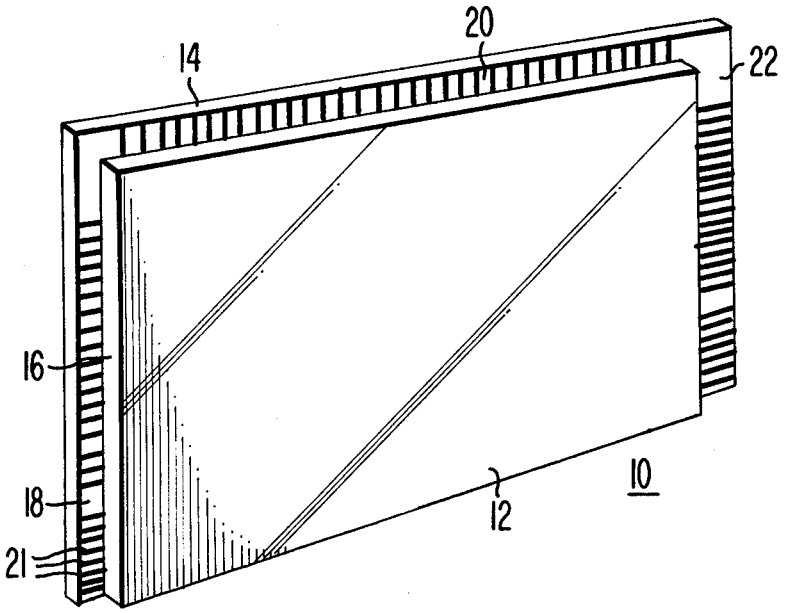
FIG. 1 is a perspective view of an image display device of the present invention.

Referring initially to FIG. 1, one form of an image display device 10 of the present invention includes an evacuated glass envelope having a flat transparent viewing front panel 12 and a flat back panel 14. The front and back panels 12 and 14 are parallel and sealed together by peripheral side walls 16. The back panel 14 extends beyond the side walls 16 of the device 10 to form terminal areas 18, 20 and 22. Each of the terminal areas has a plurality of leads 21 which interconnect to internal components for activating and controlling the device.

Figure 2:
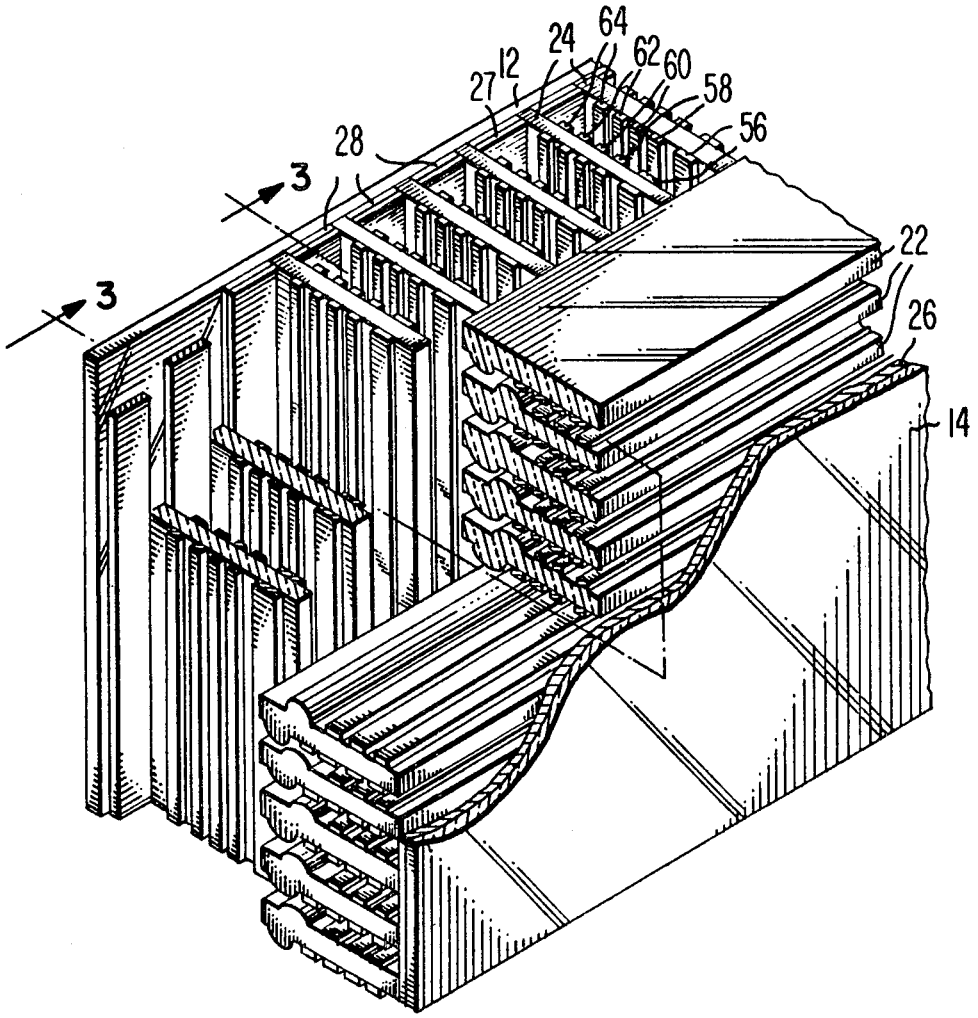
FIG. 2 is a partially cut-away perspective view of the image display device of FIG. 1.
Figure 3:
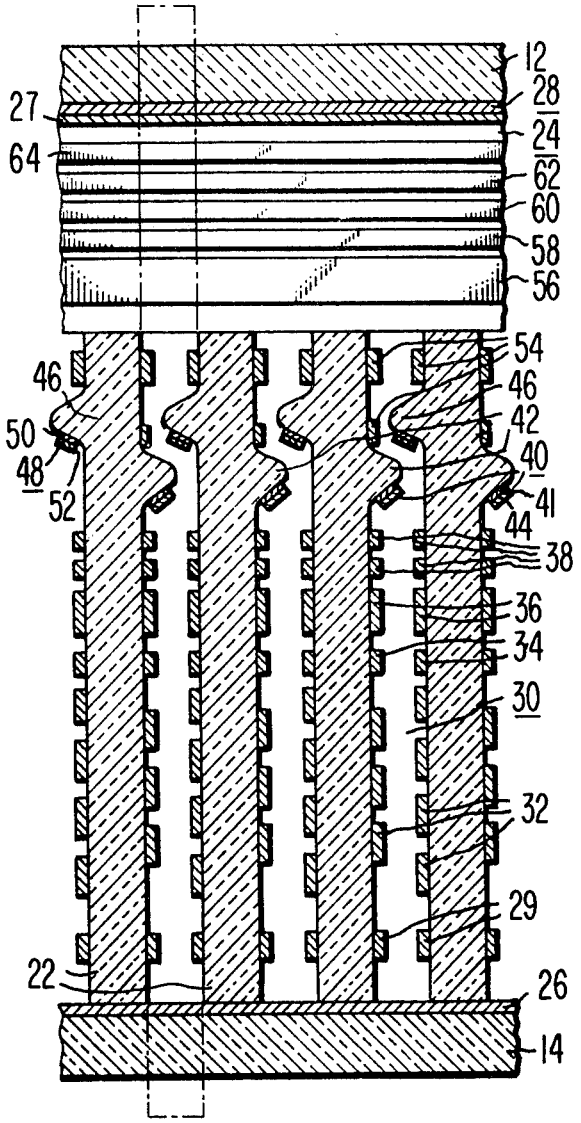
FIG. 3 is a sectional view taken along line 3—3 of FIG. 2.

The internal structure of the device 10 is shown in FIGS. 2 and 3. Excluding the inventive features, the basic structure of the device 10 can be further described by referring to previously-mentioned copending application, Ser. No. 636,096, filed Nov. 28, 1975, now U.S. Pat. No. 4,029,984 which is hereby incorporated by reference. The structure includes two orthogonal sets of parallel insulating vanes, a horizontal set 22 and a vertical set 24. The insulating vanes 22 and 24 are positioned between the front panel 12 and the back panel 14 so as to support the front and back panels against atmospheric pressure when the device is evacuated. A cathode layer 26 is disposed on, and is substantially coextensive with the pack panel 14. The cathode layer 26 comprises a photoemissive material, such as barium, which emits electrons upon impingement by photons. Thus, the cathode layer 26 may also be referred to as a photocathode. The edge surface of each of the vertical insulating vanes 24 abuts the front panel 12 so as to segment the front panel 12 into a plurality of stripes, each stripe being defined by the space between adjacent vanes 24. Disposed between each adjacent pair of insulating vanes 24 on the front panel 12 is a conductor 27 and a display phosphor 28. The display phosphor 28 may be a single color phorphor or may comprise a group of red, blue and green phosphors.

The insulating vanes 22 and 24 include structure thereon for initiating, controlling and directing the output of an electrical discharge so as to result in the desired display, i.e., optical output. Referring initially to the horizontal insulating vanes 22 of FIG. 3, the structure will be described by proceeding from the edges of the vanes 22 adjacent the cathode 26 to the edges closest the phosphor stripes 28. Following the cathode 26 is a pair of line address electrodes 29. The line address electrodes 29 are disposed on facing surfaces of the adjacent vanes 22 adjacent to and parallel with the cathode 26. Adjacent the line address electrode 29 is an electron multiplier section 30 which comprises a plurality of stripe shaped dynode members 32 which are in staggered parallel relation to each other. A pair of electron extract electrodes 34 are located in opposed spaced parallel relationship following the last dynode member 32 of the electron multiplier section 30. A pair of drift region electrodes 36 are mounted in opposed spaced parallel relationship adjacent to the pair of electron extract electrodes 34. A plurality of electron accelerating electrodes 38 are mounted in opposed spaced parallel relationship following the drift region electrodes 36. The electrodes 29, 34, 36, 38 and the dynode members 32 are in parallel relation.

A significant distinction between the device 10 of the present invention and that disclosed in previously mentioned copending application, Ser. No. 636,096 will be apparent in the following discussion. An anode electrode 40 is disposed on a first ridge 42 which is in parallel relation with the previously described electrodes and dynode members. The anode electrode 40 is on the surface of the ridge 42 which faces toward the cathode 26. The anode electrode 40 includes a layer 41 of an electrically conductive material, such as aluminum, with a layer 44 of a fluorescent material thereon. The layer 44 of fluorescent material comprises a mixture of a conventional fast acting UV fluorescent material for providing the necessary optical feedback, e.g., cerium doped lanthanum phosphate with an exponential emission time constant ($\tau$) of 27 nsec, and a relatively slow acting fluorescent material, e.g., $Y_2O_3$: Gd3% ($\tau$ = 2msec). This is to be contrasted with the structure shown in previously mentioned copending application Ser. No. 636,096 now U.S. Pat. No. 4,029,984 where only a single feedback fluorescent material was disclosed. The presence of the two fluorescent materials in the present invention is essential, in that, as will be discussed more fully later, the feedback fluorescent material is necessary to perform the function of establishing an electrical discharge so as to result in an optical output while the slow acting fluorescent material is necessary to perform the separate function of storing a portion of the energy of the electrical discharge and then emitting the stored energy to establish a subsequent electrical discharge. It should be further noted that these two functions are performed whether the fluorescent materials are mixed together in a single anode structure, as in the preferred embodiment, or whether the fluorescent materials are present on separate anode structures.

Typically, the mixture of fluorescent materials includes the slow acting fluorescent material is an amount equal to, or less than the UV phosphor. Generally, by a slow acting fluorescent material it is meant a phosphor which radiates photons after electron bombardment for a time period which is greater than the corresponding time period for the addressing time of the discharge cell. Depending upon the addressing time, this photon radiation may vary from a few microseconds (μsec) to hundreds of milliseconds (ms). Slow acting fluorescent materials include the following:

| Material | Commercial Designation | Time Constant (1) (Exponential) |
|---|---|---|
| $Y_2O_3$:Gd3% | Not commercially available, can be conventionally prepared | 2 msec |
| $YF_3$:Gd1% | Not commercially available, can be conventionally prepared | 9 msec |
| ZnS:Ag | 33-Z-646A, RCA Phosphors, TPM - 1508 B 1-66 - or can be conventionally prepared | 17 μsec |
| ZnS:Ag | 33-Z-20D, RCA Phosphors, TPM-1508B 1-66 - or can be conventionally prepared | 12 μsec |

A second ridge 46 is located on the surface of the adjacent vane 22. The second ridge 46 is in staggered parallel relation with the first ridge 42. A dynode electrode 48 is disposed on the surface of the second ridge 46 which faces the cathode 26. The dynode electrode 48 comprises a strip 50 of an electrically conductive material, such as aluminum, and a layer 52 of a material having a high secondary emission properties, such as magnesium oxide. A plurality of extract electrodes 54 are located in parallel spaced relationship adjacent and substantially parallel to the second ridge 46.

Referring now to the vertical insulating vanes 24, the structure includes opposing pairs of spaced parallel modulating, accelerating, and focusing electrodes 56, 58, 60, 62 and 64.

Generally, the operation of the display device 10 is as follows: When an electron beam is desired at a particular location, the pair of line address electrodes 29 corresponding to that location receive a bias voltage which is positive with respect to the voltage applied to the cathode 26. This biasing voltage permits electrons from the cathode 26 to strike the adjacent dynode member 32. These electrons are multiplied through the electron multiplier 30. The multiplicity of electrons is then extracted and accelerated toward the anode electrode 40 by the pair of electron extract electrodes 34 and the plurality of electron accelerating electrodes 38 respectively. Some of these electrons strike the anode electrode 40 causing the generation of electromagnetic radiation therefrom. Also, a portion of these electrons will strike the secondary emission layer 52 in the dynode electrode 48 so as to produce the emission of additional electrons. Under the influence of the electrical potentials at the extract electrodes 54, these additional electrons are accelerated toward the cathodoluminescent screen 28 as a sheet beam.

During the "on" time of the display, a sustained current buildup occurs until the loop gain of the device decreases from a value greater than unity to unity. During this "on" time, the electron sheet beam emerging from the extract electrodes 54 is modulated and accelerated toward the cathodoluminescent screen 28 by applying increased electrical potentials to the modulating, focusing, and accelerating electrodes 56, 58, 60, 62 and 64. Modulation may be achieved through space charge saturation caused by the application of a video signal between the modulation electrodes 56.

It is at this point that the significance of the present invention can be fully appreciated. As previously mentioned, in order to operate the previously described display device in a television type mode, it is necessary that each cathodoluminescent cell (shown as a dashed line in FIG. 3) be capable of a rapid repetition rate, e.g., 1/60 of a sec. or faster. Also, each cell may be required to assume its full "on" position within 1 μsec of being addressed. In order to meet these requirements, it is essential that the cell have available a constant supply of electrons in order to augment those which may be present due to background radiation and thermionic emission. In the display device of the present invention, the combination of the anode electrode 40 and the cathode 26 provide this constant supply of electrons. More specifically, the slow acting fluorescent material in the mixture of fluorescent materials in the anode electrode 40 provides a photon output therefrom which continues after the electrical discharge which causes the sustained electron emission and desired display to occur therein. Some of the photon output which lasts beyond the "on" time of the cell strikes the cathode 26 where it is converted back into free electrons, thereby ensuring the presence of the necessary free electrons when the cell is turned on again. Generally, as long as the photon output lasts for a period which corresponds to the required repetition rate, the presence of the free electrons will be ensured.

In the case of a conventional television rate line addressing scheme, where adjacent lines are addressed each 60 μsec and in which photons from the slow acting fluorescent material can spill over from one line to the next, a subsequent electrical discharge can be established within about 1 μsec by employing a slow acting fluorescent material which has an emission time in the range of from about 20 μsec to a few milliseconds. Suitable slow acting fluorescent materials for such an addressing scheme include the following: $Y_2O_3$:Gd3%, with a time constant of about 2 msec; and also ZnS:Ag, commercially available from RCA under the designation 33-Z-646A, with a time constant of about 17 μsec. In the case of a conventional television field rate addressing scheme, or a line addressing scheme in which the photons from the slow acting fluorescent material cannot spill over from one line to the next, the slow acting fluorescent material should have an emission time in the range of from about 5 msec to 500 msec. A suitable slow acting fluorescent material for such an addressing scheme is $YF_3$:Gd1%, with a time constant of about 9 msec. It is to be noted that, in any addressing scheme, the slow acting fluorescent material of the anode may comprise a mixture of one or more of such fluorescent materials.

If desired, a single anode electrode can include the display phosphor, the optical feedback phosphor, and the slow acting fluorescent material. For example, in the previously described structure, the anode electrode 40 and ridges 42 and 46 can be omitted by providing a cathodo-luminescent screen which includes a mixture of phosphors which, in combination, perform the separate functions of: display; providing optical feedback; and ensuring the presence of free electrons so as to provide for rapid addressing. One such mixture is: willemite for the display; cerium doped lanthium phosphate for the optical feedback; and $Y_2O_3$:Gd3% for ensuring the presence of free electrons. The constituents of the mixture may be in the ratio of 1:1:1.

Figure 4:
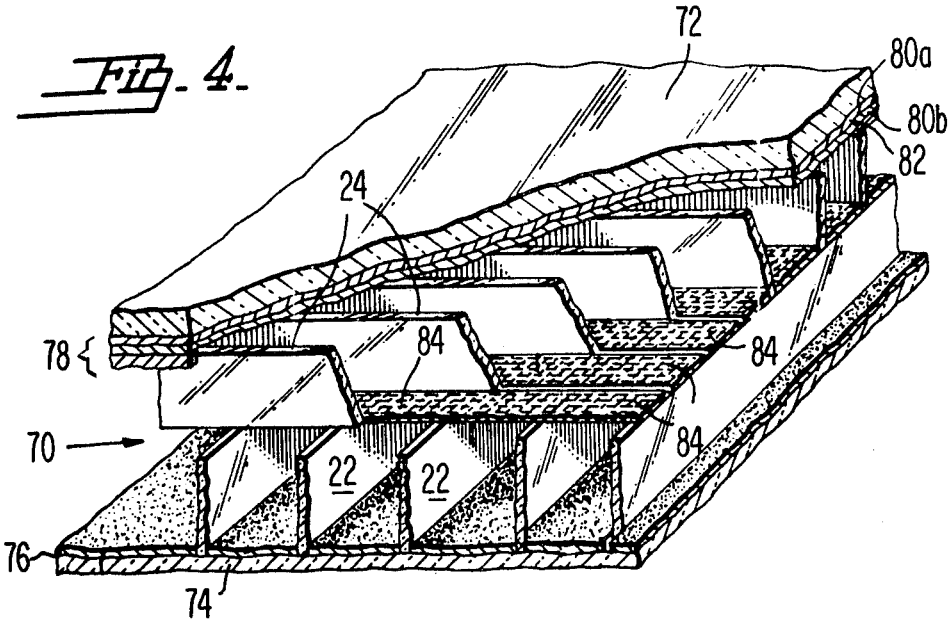
FIG. 4 is a partially cut-away perspective view of another form of the image display device of the present invention.
Figure 5:
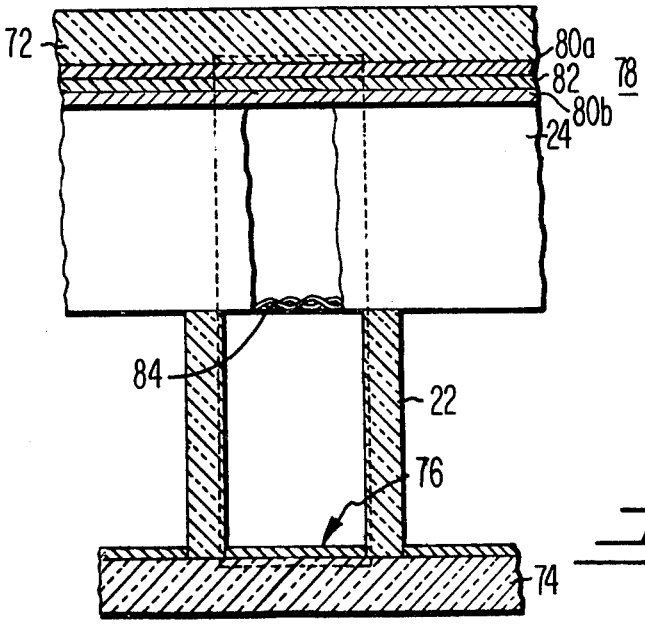
FIG. 5 is an enlarged sectioned elevational view of a portion of the device shown in FIG. 4, depicting one cathodoluminescent cell.

A variation of the image display device of the present invention is shown in FIGS. 4 and 5 and is generally designated as 70. The basic structure of the image display device 70 is further discussed in previously-mentioned copending application, Ser. No. 636,096 now U.S. Pat. No. 4,029,984. The display device 70 comprises an evacuated envelope having front and back panels 72 and 74 respectively. Peripheral side walls (not shown) support the front and back panels in substantially spaced parallel relation to each other. On the back panel 74 is a cathode 76 which is similar to the cathode 26 of the previously-described display device 10. On the front panel 72 is an anode electrode 78 (partially shown). The anode electrode 78 includes two layers 80*a* and 80*b* of fluorescent material separated by a layer 82 of conductive material. Fluorescent layer 80*a* is of a material, such as willemite, which emits visible electromagnetic radiation under electron bombardment. The fluorescent layer 80*b* includes at least one of the previously-described slow acting fluorescent materials and a feedback phosphor. One distinguishing feature between the display device 70 and the previously-described display device 10 is that the display device 70 includes no electron multiplier dynodes. However, both display devices include the use of means for storing energy in a cell and then employing the stored energy to establish a subsequent electrical discharge. With regard to the image display device 70, it should be noted that the use of a grid 84, although preferably, is not necessary.

Other variations of the optical feedback display device of the present invention are possible. Such variations may include material substitutions, spatial rearrangements and dimensional particularities. These variations depend, to a great degree, upon the display requirements. However, in any variation, it is desirable to place the slow acting fluorescent material in a position in the cell where it intercepts a sufficient number of electrons so as to maximize efficiency. Similarly, in any variation, it is desirable to match the emission wavelength of the slow acting fluorescent material to the photo response of the cathode.

In one spatial rearrangement, the display device of the present invention may include a matrix which comprises a plurality of parallel multiplier plates which are in orthogonal relation to a plurality of segmented cathode stripes. Such a structure is more fully disclosed in previously mentioned copending patent application of Ser. No. 672,122. In this embodiment, addressing of the multiplier is achieved through individually addressing the cathode stripes.

Figure 6:
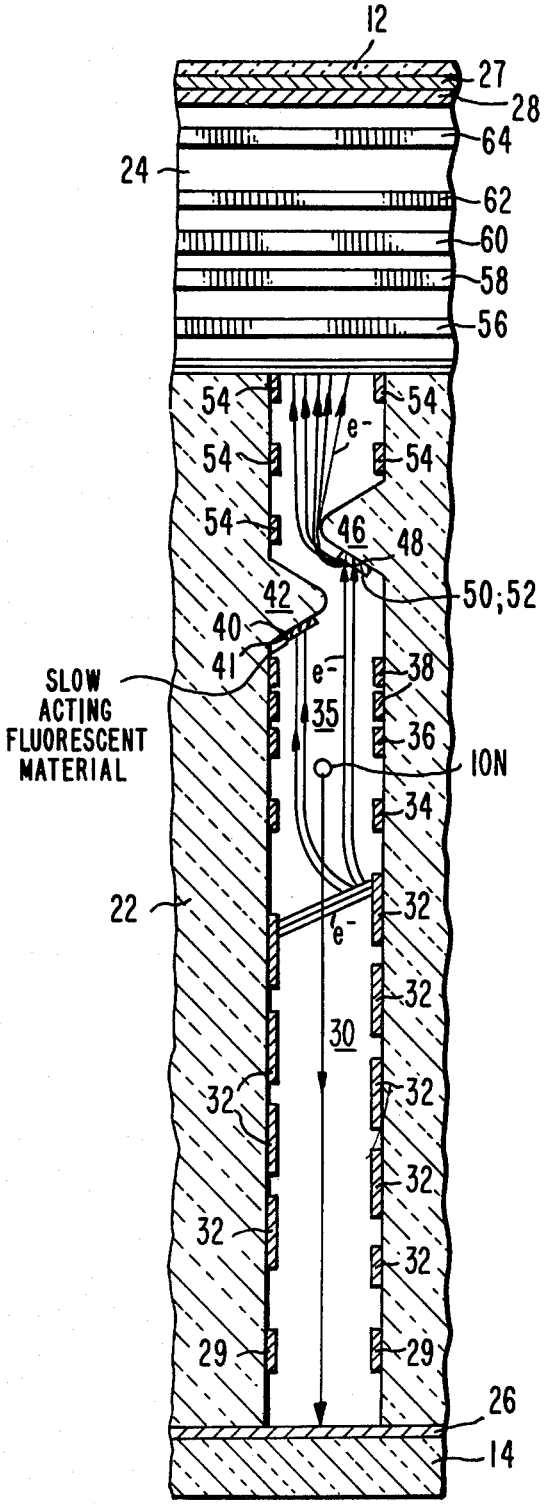
FIG. 6 is a sectional view depicting one cathodoluminescent cell of a different form of electrical discharge display device.
Figure 7:
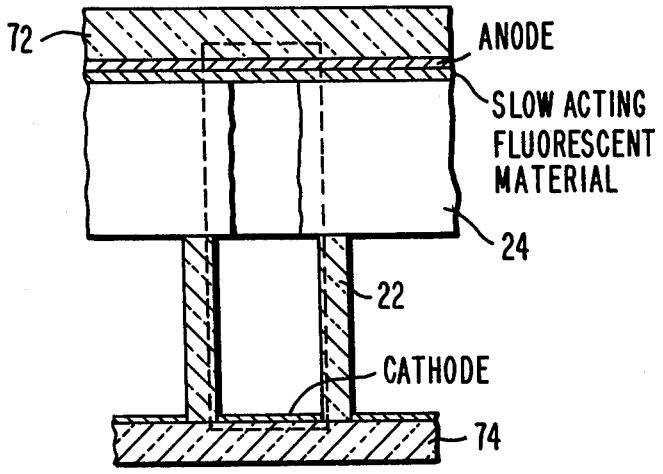
FIG. 7 is a sectional view depicting one cell of a second different form of electrical discharge display device.

Although the present invention has heretofore been described in connection with electrical discharge devices in which sustained electron emission is obtained through the use of optical feedback, the invention is also applicable to other forms of electrical discharge display devices. For example, the previously described cathode-anode combination can be employed in an ion feedback display device, such as the one shown in previously-mentioned U.S. Pat. Nos. 3,904,923; 4,001,619 and 4,001,620 and shown in FIG. 6. In such a structure, the combination of slow acting fluorescent material and appropriate cathode will again ensure the presence of sufficient free electrons so as to rapidly initiate electrical discharges and the resultant optical outputs. Similarly, such an anode-cathode combination can be employed in a plasma discharge display device, such as the one shown in previously mentioned U.S. Pat. No. 3,767,968 and shown in FIG. 7. Note that, in the ion feedback and plasma discharge display devices, the fast acting feedback phosphor is unnecessary.

The display device and operating method of the present invention provide for the necessary electrical discharge which results in the desired optical output. In addition, the invention provides for the presence of free electrons necessary for rapid addressing. This is accomplished by separating the functions of: 1. providing the necessary electrical discharge; and 2. providing for the presence of free electrons. This allows each of these functions to be optimized.

I claim:

1. An image display device comprising an evacuated envelope within which is disposed a plurality of cathodoluminescent cells in a matrix array, each cell including:

a. a source of electrons comprising:
   1. a cathode electrode having means for emitting electrons in response to impinging electromagnetic radiation;
   2. means, including said cathode electrode, for establishing an electrical discharge, said discharge means further comprising:
      i. an anode electrode having means for producing electromagnetic radiation in response to bombardment by electrons;
      ii. an open channel between said anode electrode and said cathode electrode whereby a fraction of the electromagnetic radiation produced by said anode electrode is clear to feed back to and impinge upon said cathode electrode; and
      iii. means for sustaining a flow of electrons from said cathode electrode to said anode electrode;

b. electron beam formation means;

c. means for modulating a flow of electrons from said electron beam formation means;

d. means for accelerating the modulated flow of electrons;

e. a cathodoluminescent screen excitable by the accelerated and modulated flow of electrons, said screen being separated from said anode electrode; and f. additional means for storing a portion of the energy of said electrical discharge and then spontaneously emitting said stored energy to establish a subsequent electrical discharge.

2. An image display device in accordance with claim 1 in which said additional means for storing and emitting said energy comprises an anode electrode having means for producing photon radiation in response to bombardment by electrons, said anode electrode being disposed to one side of said cathode such that at least some of said photon radiation can reach said cathode.

3. An image display device in accordance with claim 2 in which said anode electrode includes a slow acting fluorescent material which radiates photons for a time period after electron bombardment which continues beyond the on time of said cell.

4. An image display device in accordance with claim 3 in which said slow acting fluorescent material comprises $YF_3$:Gd1%.

5. An image display device in accordance with claim 3 in which said slow acting flourescent material comprises $Y_2O_3$:Gd3%.

6. An image display device in accordance with claim 3 in which each of said cells further includes an electron multiplier disposed between said cathode and said anode electrode, said electron multiplier including at least one dynode for multiplying the number of electrons which pass from said cathode to said anode electrode.

7. An image display device in accordance with claim 6 in which said means for establishing an electrical discharge comprises photon feedback means.

8. An image display device in accordance with claim 7 in which said anode electrode includes a mixture which includes said slow acting fluorescent material and a feedback phosphor.

9. An image display device in accordance with claim 6 in which said means for establishing an electrical discharge comprises ion feedback means.

10. An image display device in accordance with claim 6 in which each of said cells includes a cathodoluminescent screen in addition to said anode electrode.

11. An image display device in accordance with claim 3 in which said means for establishing an electrical discharge comprises plasma discharge means.

* * * * *